US011072475B2

(12) United States Patent
Weiksnar

(10) Patent No.: US 11,072,475 B2
(45) Date of Patent: Jul. 27, 2021

(54) BOTTLE CARRIER AND STORAGE DEVICE

(71) Applicant: Jodi Weiksnar, Palm City, FL (US)

(72) Inventor: Jodi Weiksnar, Palm City, FL (US)

(73) Assignee: FOUR KID INVESTORS LLC, Palm City, FL (US)

( * ) Notice: Subject to any disclaimer, the term of this patent is extended or adjusted under 35 U.S.C. 154(b) by 0 days.

(21) Appl. No.: 16/573,296

(22) Filed: Sep. 17, 2019

(65) Prior Publication Data

US 2020/0087044 A1 Mar. 19, 2020

Related U.S. Application Data

(60) Provisional application No. 62/732,254, filed on Sep. 17, 2018.

(51) Int. Cl.

| | |
|---|---|
| ***B65D 71/50*** | (2006.01) |
| ***B65D 25/20*** | (2006.01) |
| ***B65D 71/52*** | (2006.01) |

(52) U.S. Cl.

CPC ..... *B65D 71/50* (2013.01); *B65D 25/20* (2013.01); *B65D 71/0003* (2013.01); *B65D 2571/00333* (2013.01); *B65D 2571/00432* (2013.01); *B65D 2571/00981* (2013.01)

(58) Field of Classification Search

CPC .... B65D 71/50; B65D 71/0003; B65D 25/20; B65D 2571/00333; B65D 2571/00432; B65D 2571/00981; A45F 3/16; A45F 2200/0583

See application file for complete search history.

(56) References Cited

U.S. PATENT DOCUMENTS

| | | | | |
|---|---|---|---|---|
| 3,097,740 A * | 7/1963 | Poupitch | ..... | B65D 71/50 206/143 |
| 3,913,778 A | 10/1975 | Oglesbee | | |
| 5,188,413 A * | 2/1993 | Nathan | ..... | B65D 71/50 206/151 |
| 5,433,373 A * | 7/1995 | Zoeller | ..... | B65D 5/322 229/117.26 |
| 5,487,465 A * | 1/1996 | Broskow | ..... | B65D 71/504 206/150 |
| 7,984,813 B1 | 7/2011 | Tapager | | |

(Continued)

FOREIGN PATENT DOCUMENTS

| | | | | |
|---|---|---|---|---|
| AU | 2014271248 | 6/2015 | | |
| CA | 2496648 A1 * | 8/2006 | ..... | B65D 71/50 |

(Continued)

OTHER PUBLICATIONS

Pro Bike Tool Bike Water Bottle Holder via Amazon.com, Sep. 9, 2016. (https://www.amazon.com/dp/B01K2BOUN4/ref=sspa_dk_detail_1?pd_rd_i=B017RPEXLC&pd_rd_w=7wiTx&pf_rd_p=085568d9-3b13-4ac1-8ae4-(24a26c00cb0c&pd_rd_wg=HxDUT&pf_rd_r=6TXFDCJQCMPJD36310DV&pd_rd_r=480b6a5c-bd87-4b6b-9730-cb4e60157be5&spLa=ZW5jcnlwdGVkUXVhbGlmaWVyPUExR00zUk02Q0IMWFRRJmVuY3J5cHRIZEIkPUEwNTQ4NzMzM1E4TkpSVIBZVVRRMyZlbmNyeXB0ZWRBZEIkPUEwNzgzMjA2MzJaUFRSUDBCVVBZWCZ3aWRnZXROYW1IPXNwX2RldGFpbCZhY3Rpb249Y2xpY2tSZWRpcmVjdCZkb05vdExvZ0NsaWNrPXRydWU&th=1).*

(Continued)

*Primary Examiner* — Stephen A Vu

(74) *Attorney, Agent, or Firm* — Kilpatrick Townsend & Stockton LLP

(57) ABSTRACT

Embodiments of the present disclosure relate generally to a device designed to store, dry, transport and otherwise manage water bottles and/or their lids. Providing storage and transport for these and other types of bottles can help (Continued)

promote the use of reusable bottles and ease their transport to locations where multiple bottles may be used.

15 Claims, 16 Drawing Sheets

(56) References Cited

U.S. PATENT DOCUMENTS

| | | | | |
|---|---|---|---|---|
| 8,544,915 | B1 * | 10/2013 | Winkler | A45F 5/10 294/160 |
| 2002/0148868 | A1 * | 10/2002 | Dion-Bildstein | B60N 3/103 224/401 |
| 2005/0263527 | A1 | 12/2005 | Maldonado et al. | |
| 2012/0280096 | A1 * | 11/2012 | Goldman | B60N 3/101 248/224.8 |
| 2015/0366334 | A1 | 12/2015 | Marney | |
| 2017/0066493 | A1 * | 3/2017 | Chuang | B62J 11/00 |

FOREIGN PATENT DOCUMENTS

| | | | | |
|---|---|---|---|---|
| EP | 3369670 | A1 * | 9/2018 | B65D 21/0233 |
| GB | 2430927 | A * | 4/2007 | |
| WO | WO-2011147020 | A1 * | 12/2011 | B65D 5/5038 |

OTHER PUBLICATIONS

EP19197900.4 , "Partial European Search Report", dated Jan. 21, 2020, 14 pages.

* cited by examiner

BOTTLE CARRIER AND STORAGE DEVICE

This application claims the benefit of U.S. Provisional Application Ser. No. 62/732,254, filed Sep. 17, 2018 titled "Bottle Carrier and Storage Device," the entire contents of which are hereby incorporated by reference.

FIELD OF THE DISCLOSURE

Embodiments of the present disclosure relate generally to a device designed to store, dry, transport and otherwise manage water bottles and/or their lids. Providing storage and transport for these and other types of bottles can help promote the use of reusable bottles and ease their transport to locations where multiple bottles may be used.

BACKGROUND

Empty water bottles are lightweight with a high center of gravity. They can fall over easily, can take up counter and cabinet space, and typically cannot be stacked. The shape of most water bottles usually requires that they air dry. This means that bottles may remain on a drying rack or counter for long time periods. Because lids are usually stored separately from the bottles (because bottles dry more effectively without lids), bottle lids are routinely misplaced or lost. Once dry, water bottles are often stored in kitchen cabinets. This can result in clutter, loss of cabinet space, and falling water bottles.

Additionally, there are instances when a number of bottles may need to be transported from one location to another location, such as for a cycling/racing team, marathon running preparation, sports events, or any other event that requires a number of its participants to remain hydrated. One person transporting a number of bottles can be cumbersome. Accordingly, bottle carrier and storage device solutions are desirable.

BRIEF SUMMARY

Embodiments of the present invention provide a bottle carrier and storage device, comprising: a central support structure; one or more brackets extending from the central support structure, each of the one or more brackets comprising a bottle securement portion. The device can be useful for carrying and storing any type of bottles. The one or more brackets may be configured to be removably secured to the central support structure. In some examples, the device has a lower platform or a base. Additionally or alternatively, the device may have a lid support. The lid support may support a storage bag configured to be secured with respect to the central support structure. In other examples, the storage bag may be secured to an upper ring or cap. The storage bag may be a fabric mesh bag, which can hold items or allow items to dry.

In some examples, the device can be provided in two units, a first unit comprising a carrier device and a second unit comprising a carrier device comprising, the second unit configured to be mounted with respect to the first unit.

DETAILED DESCRIPTION

Embodiments of the present disclosure provide a solution that can maintain bottles and their lids in one container, together in one location. The disclosed device can be used as a single unit, or it may be formed as a modular unit allowing it to be stacked with multiple units. For example, multiple units may be securely connected vertically. The device is designed to securely and snugly contain bottles to prevent them from rattling or coming loose from the device. The disclosed device also provides a central storage area for lids or any other items to be stored or carried.

Although this description refers to water bottles throughout, it should be understood that the bottles being carried may be any type of bottle, such as sport drink bottles, baby bottles, alcohol bottles, plastic bottles, dog water bottles, re-usable water bottles, or any other type of container for which it may be desirable to have a single device for storage and/or transport of the container and/or lid combination.

Figure 1A:
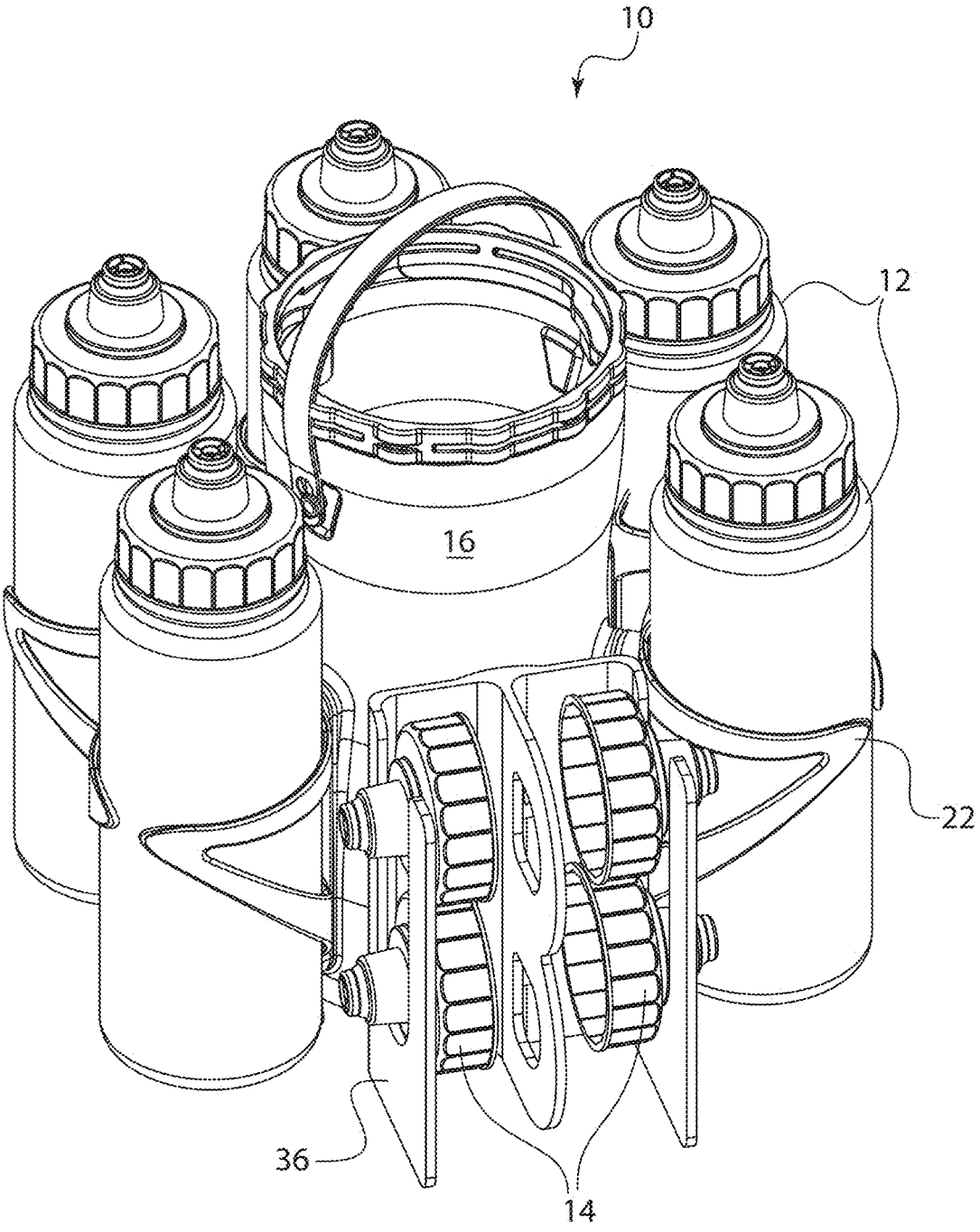
FIG. 1A shows a side perspective view of one embodiment of a bottle carrier and storage device.
Figure 1B:
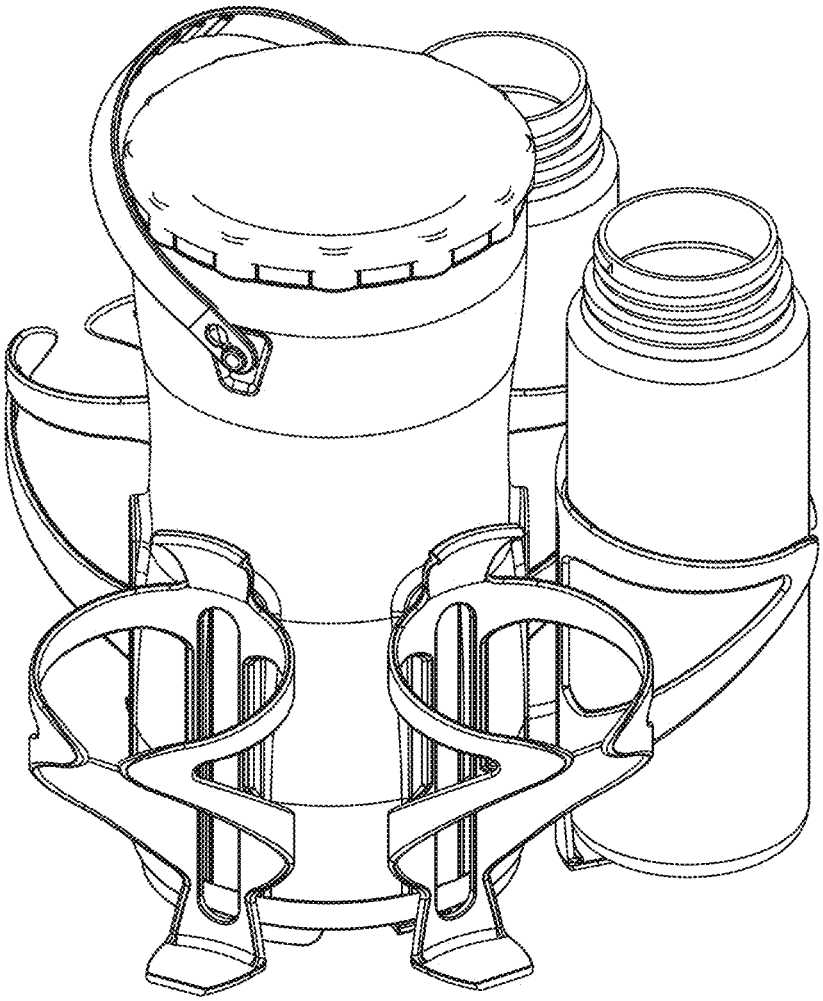
FIG. 1B shows a side perspective view of the device of FIG. 1A with bottles removed to illustrate features of brackets.

FIGS. 1A and 1B illustrate one example of a bottle carrier and storage device 10 disclosed herein. The bottle carrier and storage device 10 allows a number of bottles 12 to be stored, dried, transported, or otherwise contained so that less countertop or cabinet space is used. Lids 14 may also be stored and dried on the device 10. Further, use of the device 10 may ease carrying multiple bottles from location to location. The bottles, along with their lids, can be easily moved from countertop to cabinets to an off-site location. The device 10 also helps allow the bottles 12 to dry and be stored out of sight, without losing track of their lids 14. Filled bottles 12 can also be transported to locations where multiple water bottles are needed. FIG. 1A shows a device 10 filled with and configured for carrying bottles, with the lids carried in a specially-designed lid carrying feature referred to as a lid support, described below. FIG. 1B shows a device 10 configured to carry a plurality of bottles, each bottle contained within a bracket, and illustrating empty brackets for ease of illustration.

Figure 2:
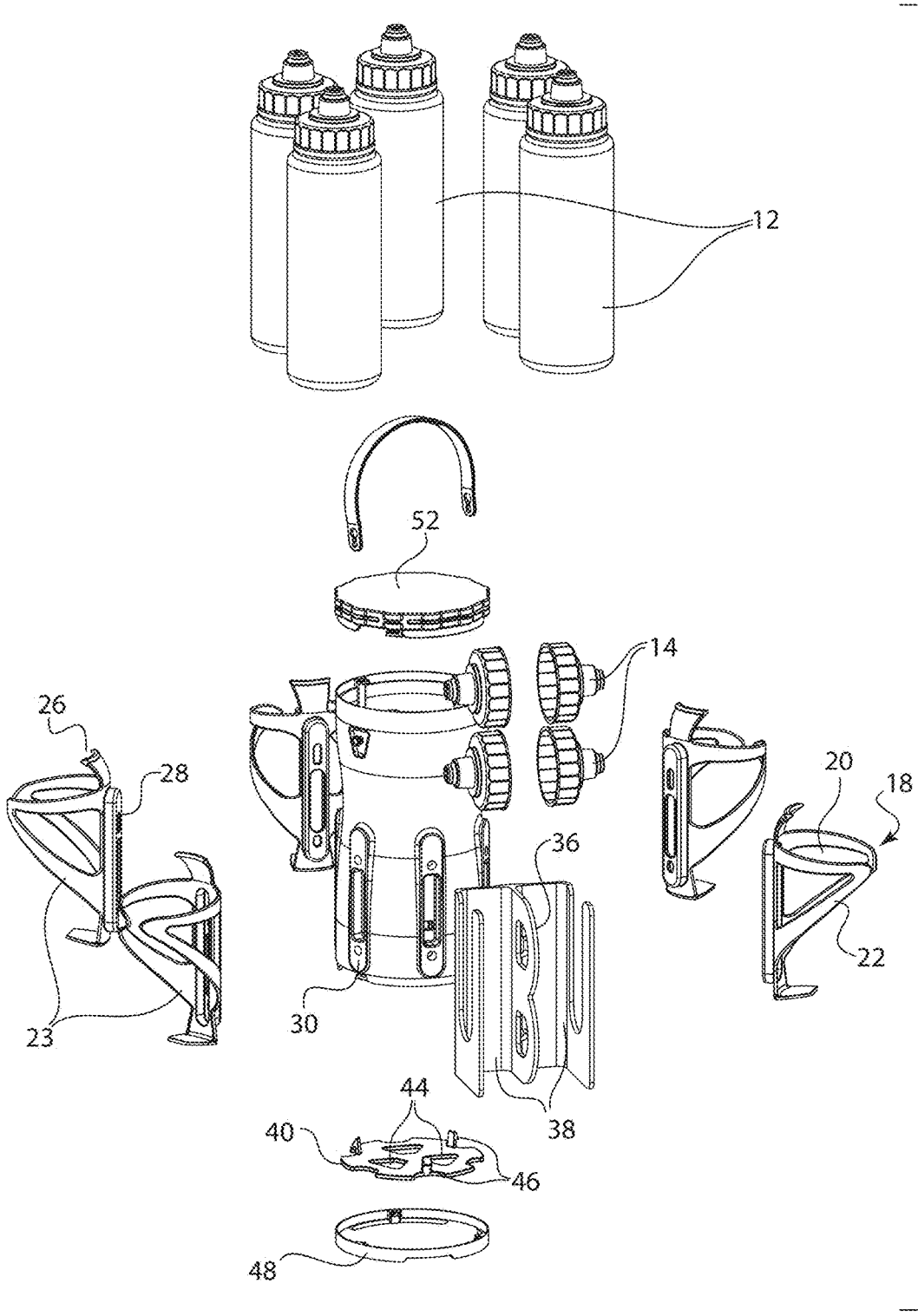
FIG. 2 shows an exploded view of a bottle carrier and storage device.

As shown by the exploded view of FIG. 2, the device 10 has a central support structure 16. Although the central support structure 16 is illustrated as having a rounded cylindrical shape, it should be understood that any shape is possible and considered within the scope of this disclosure. For example, central support structure 16 may be oblong, square, rectangular, triangular, or any type of polygon, such as pentagonal, hexagonal, heptagonal, octagonal, or any other appropriate shape. It is further possible for the central support structure to have a U-shape, a T-shape, or any other appropriate perimeter structure. The general intent is that the central support structure 16 has a size and shape configured to support one or more brackets or receptacles 18 suitable for securing a bottle. In one embodiment, the brackets 18 are similar to bottle cages used on bicycles. For example, each bracket 18 are generally has a bottle receiving opening 20 and a bottle securement section 22. In a specific example, the bottle securement section 22 may feature two curved arms 23, but it should be understood that other securement features are possible and considered within the scope of this disclosure. In the example shown, curved arms 23 are shaped and configured to receive the water bottle 12 shown. However, if the bottle carrier and support device 10 is configured to carry and support baby bottles or other types of containers, the bottle securement section 22 will be appropriately configured and sized. Each bracket 18 is affixed to the central support structure 16 so that the base of the central support structure 16 and the bottom of bracket 18 are generally on the same horizontal plane. This can increase the effective area of the base of the structure 16 by approximately 50% and thus improve the stability of the unit.

Figure 3:
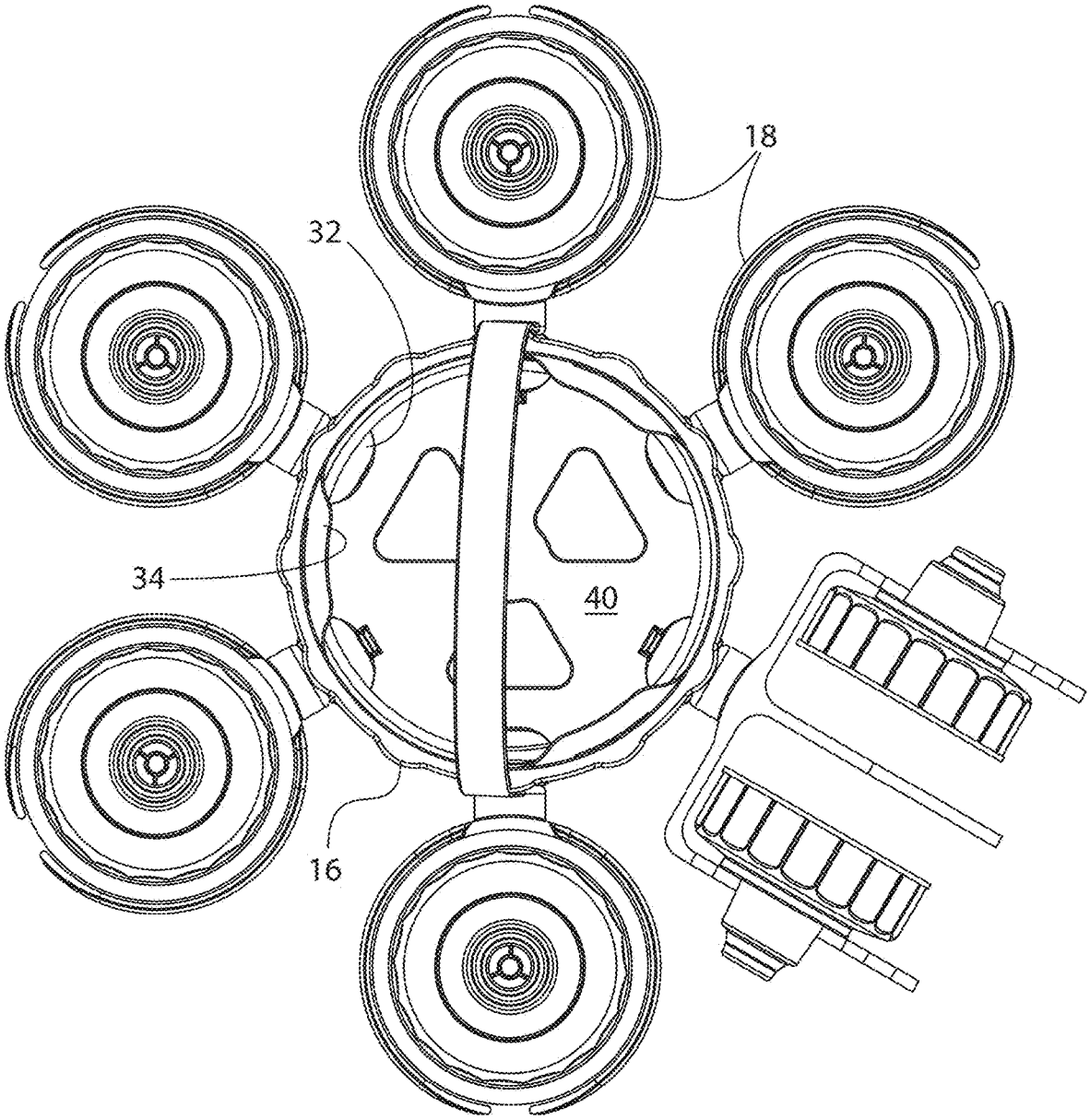
FIG. 3 illustrates a top plan view of FIG. 1A.

Each bracket 18 is also provided with a support structure attachment feature 26. In a specific example, the attachment feature 26 may be a rear plate 28 that cooperates with a corresponding plate 30 positioned on the central support structure 16. The plates 28, 30 may snap into cooperation with one another. In another example, the plates 28, 30 may be secured to one another using one or more fixation features, such as screws, magnets, nuts, bolts, or any other appropriate fixation feature. In another example, bracket 18 may be secured directly to a central support structure 16 without the use of plates 28, 30 via any appropriate fixation feature or securement method. It is possible for an internal wall, cap, or cover to be positioned along an internal surface 34 of the central support structure 16 in order to protect a user's hands from scraping against the fixation feature, as illustrated by FIG. 3. It is envisioned that these attachment methods may allow removal and replacement of the bracket, if desired, and as outlined further below for modularity purposes. In some instances, the brackets may be traditional cycling brackets (used to secure a water bottle to a crossbar of bicycle). The removability of the brackets may thus be accomplished using standard cycling tools, an allen wrench, a screwdriver, or any other appropriate tool.

In a further example, bracket 18 may be secured to the central support structure 16 via an adhesive, glue, cement, heat welding, or any other appropriate securement method. Such securement methods may limit the removability and replaceability of the brackets 18, but they may lessen manufacturing costs. In another example, the bracket 18 may be magnetically coupled to the central support structure 16. In another example, the bracket 18 may be integrally formed with the central support structure 16, such that the entire feature is injection molded in one piece. (This option may increase manufacturing costs and may also make replacement of a damaged bracket impossible, but it is included as a manufacturing possibility.) As described, one of ordinary skill in the art will understand various ways to secure the bracket 18 to the central support structure 16. The above examples are not intended to be limiting in any way.

In the particular embodiment shown in FIG. 2, the bracket 18 is secured to the central support structure 16 by a sliding fit comprising a tongue slideably receivable in a groove. Optionally, the tongue and groove fit can be formed as a dovetail joint to provide additional security of the bracket 18 to the central support structure 16.

Referring back to FIGS. 1 and 2, the device 10 may also feature one or more lids supports 36. FIGS. 1 and 2 illustrate a single lid support 36 used in combination with five brackets 18, but it should be understood that any number of bracket combinations is possible and considered within the scope of this disclosure. The central support structure 16 may be sized larger or sized smaller depending on various requirements.

For example, if a user needed to carry more lids than would be possible with a single lid support 36, the device may modified to accept multiple lids supports 36. This modification may be conducted at the user level, such that a consumer may purchase additional brackets 18 and/additional lids supports 36 and manually interchange the options to customize the bottle carrier and storage device 10. The lid support 36 may be secured to the central support structure 16 by the same securement method as the brackets 18 to the central support structure 16 discussed above. This allows one or more brackets 18 to be replaced by one or more lid supports 36 or vice versa depending on user requirements. Such interchangeability may also allow removal and replacement of a damaged bracket 18 and/or damaged lid support 36. In another embodiment, it is possible for such customization to occur at the manufacturing level. For example, if a certain cycling team has specific requirements, the bottle carrier and storage devices 10 may be ordered, customized, and delivered in a specific requested configuration.

In FIGS. 1-3, the lid support 36 is illustrated as having at least one channel 38 sized and configured to receive at least one bottle lid 14. The version illustrated by FIGS. 1 and 2 shows a lid support 36 having dual channels 38, with each of the channels 38 sized and configured to receive two lids 14. It should be understood that different numbers of channels 38 sized and configured to receive different numbers of lids 14 are possible and considered within the scope of this disclosure. Additionally, if the bottle carrier and support device 10 is configured to carry and support baby bottles or other types of containers, the channels 38 will be appropriately sized. The lid support 36 may be secured or otherwise associated with the central support structure 16 using any of the above-described attachment features or securement methods for the bracket(s) 18.

Figure 12A:
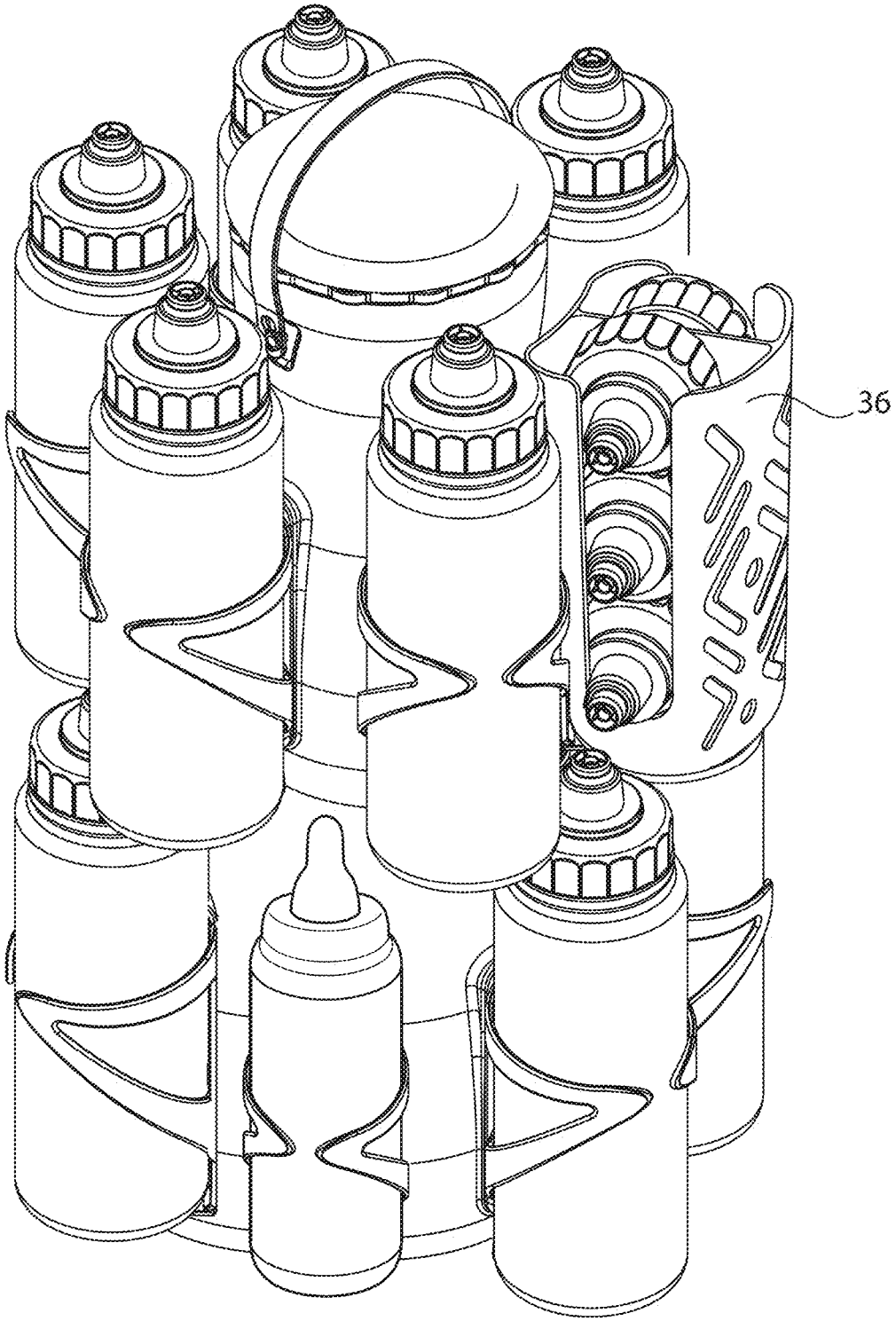
FIG. 12A illustrates a front perspective view of an alternate lid storage.
Figure 12B:
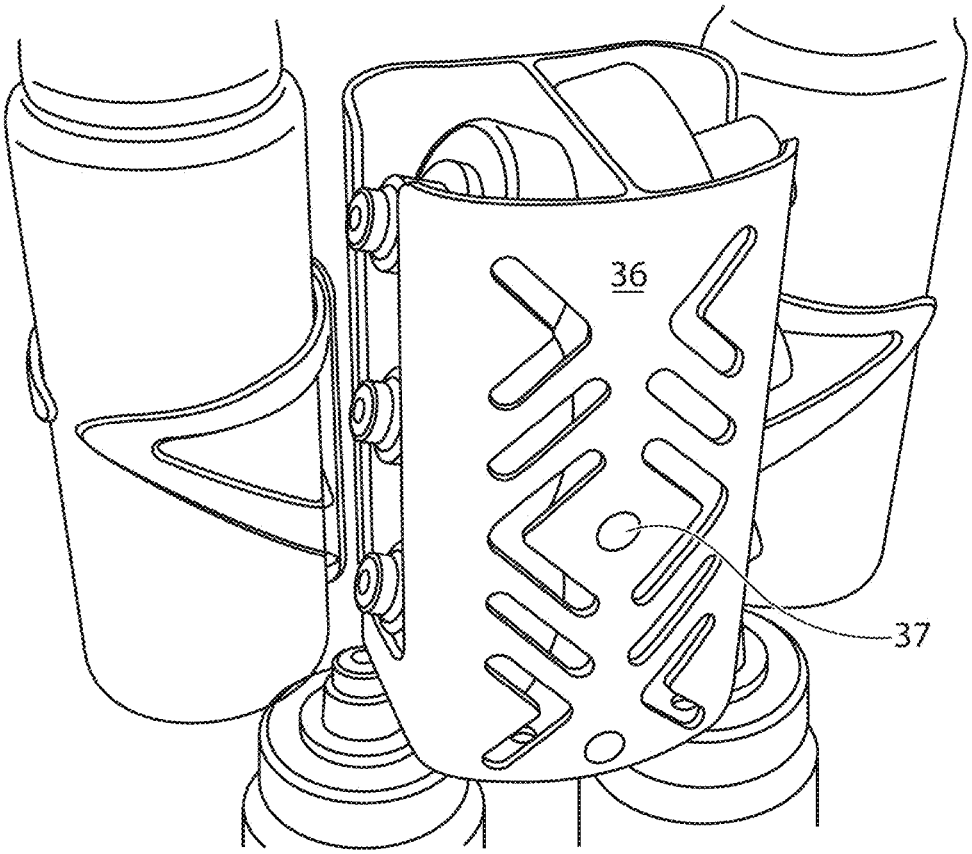
FIG. 12B illustrates a side perspective view of the alternate lid storage of FIG. 12A.

FIGS. 12A and 12B illustrate an alternate design for lid support 36'. Here, the lid support 36' may be formed as a tubular or box structure having an open end for receiving the bottle caps or lids. Channels 38 are formed in the walls of the tubular or box structure that are configured to receive the teats or valve of the bottle cap or lid. A portion of the walls of the lid support 36' is slotted or perforated to allow air to circulate through the tubular or box structure of the lid support 36'. In these figures, the lid support 36' has a slotted chevron pattern or other slotted pattern which can help encourage bottle cap/lid aeration. This lid support 36 may also be provided with an installation opening 37 on its surface which can receive a screw or other securement member in order to secure the lid support 36 to the central support structure 16. Lid support 36' may also be provided with lower drain holes in its bottom or lower base portion.

Figure 4:
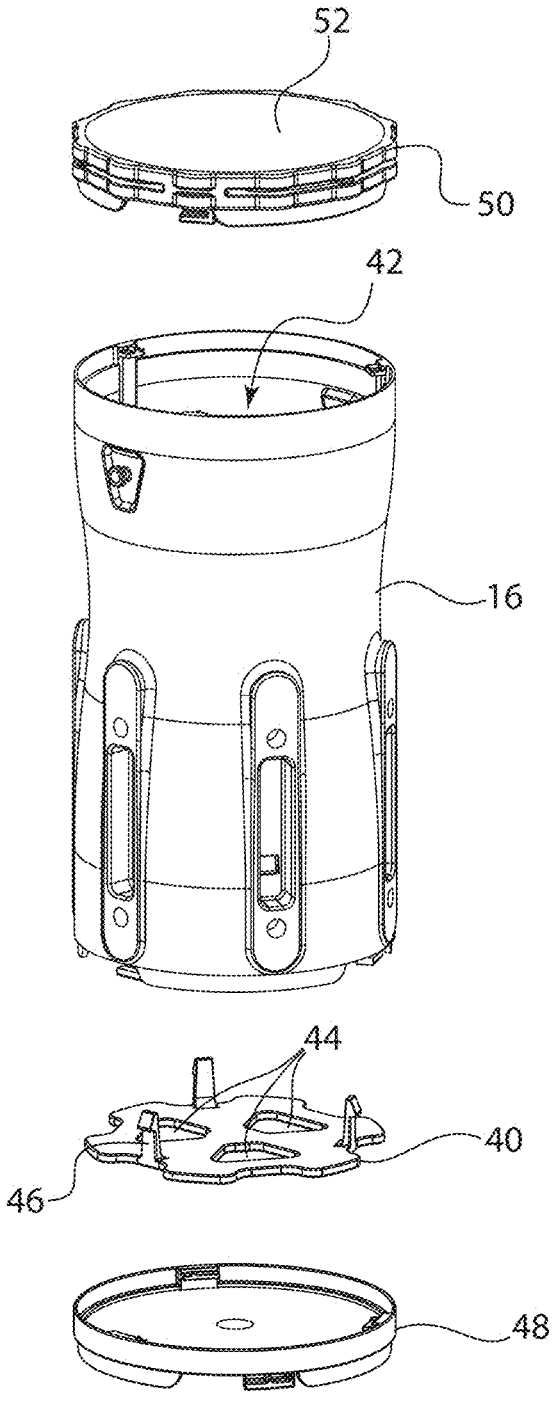
FIG. 4 illustrates an exploded view of a central support structure and various components.
Figure 5:
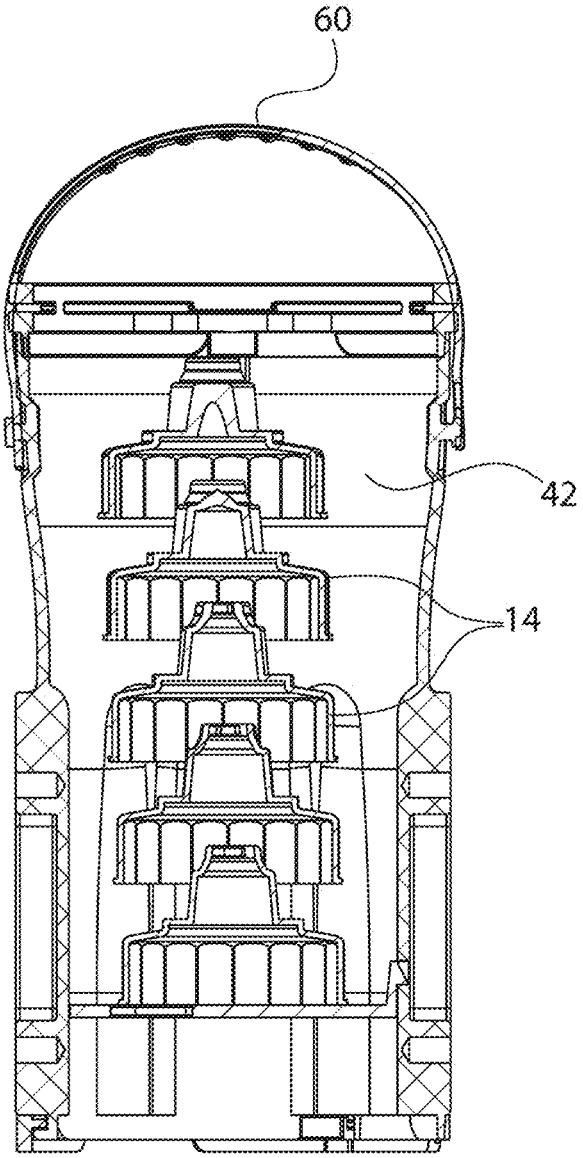
FIG. 5 illustrates a cross-sectional view of a bottle carrier and storage device containing lids in its interior section.

Referring now to FIG. 4, the device 10 may also be provided with an optional lower platform 40. The lower platform 40 may be provided in order to allow the device 10 to hold smaller items within the central support structure 16. For example, the central support structure 16 may be hollow, such that it defines an interior storage space 42. As illustrated by FIG. 5, interior storage space 42 may be used to store stacked lids 14. Lower platform 40 can provide a support to prevent lids from falling through the hollow support 16. Rather than providing a solid or otherwise non-perforated lower platform, it has generally been determined that lower platform 40 may have one or more openings 44 defined therein. It is possible for openings to be shaped as small perforations, slits, circular openings, openings shaped as shown, or any other possible shape. The optional lower platform 40 may also have upwardly extending prongs 46 which may be used to help secure the lower platform 40 into a lower portion of the central support structure 16.

Figure 6:
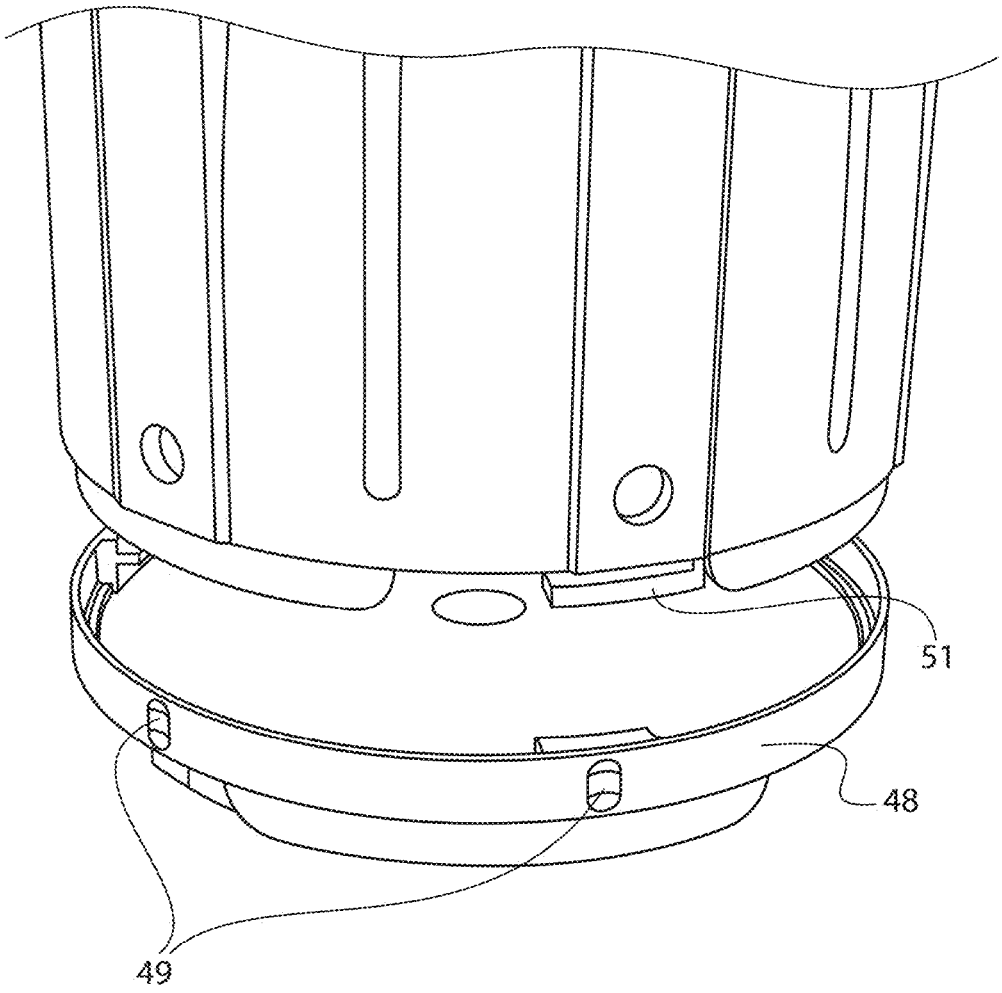
FIG. 6 illustrates an exploded view of a platform.
Figure 10:
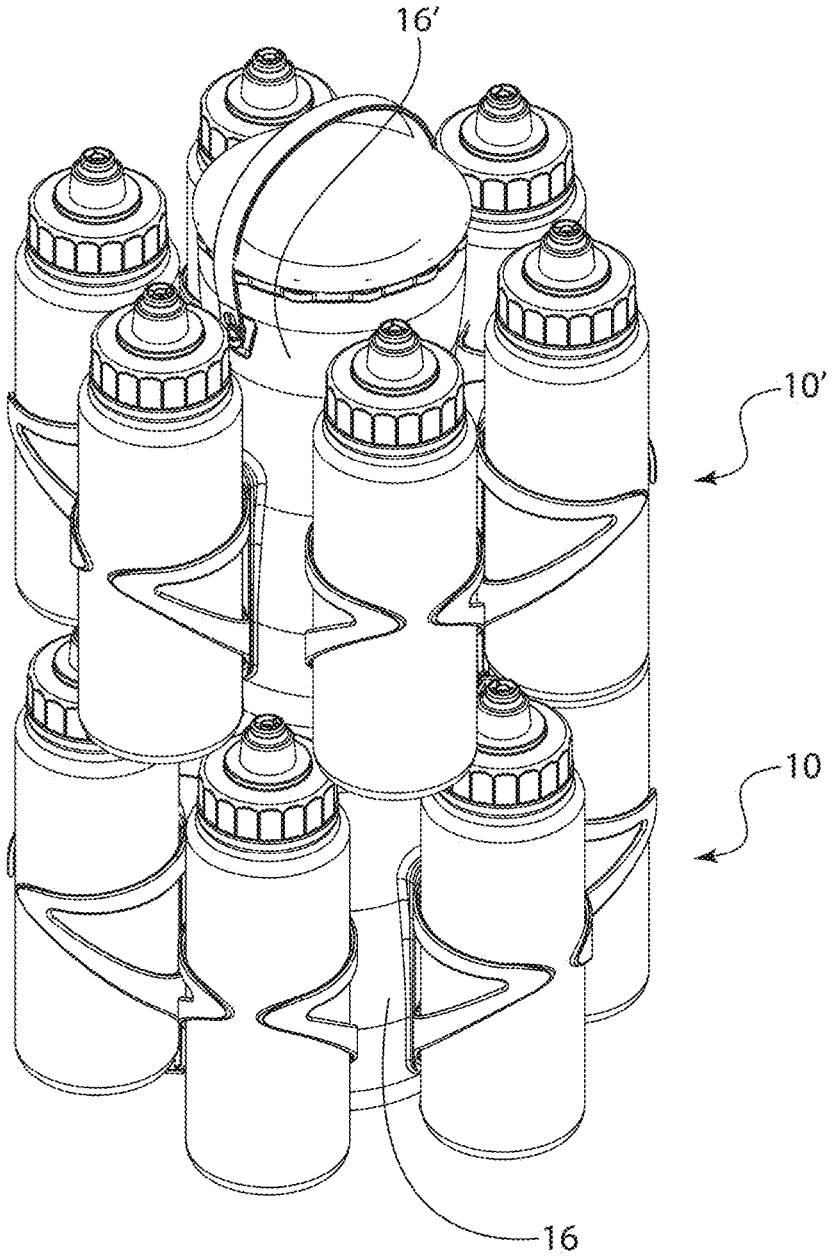
FIG. 10 illustrates two units connected with respect to one another.

FIGS. 2 and 4 also illustrate a base ring 48. In one embodiment, the base ring 48 may provide a solid base which functions as a floor. In an alternate embodiment, the base ring 48 may be offered with small openings, slits, circular openings, or other types of openings. In this example, the base ring 48 functions as—and takes the place of—the optional lower platform 40 described above. Either base ring 48 configuration may be available. FIG. 6 illustrates an alternate base ring 48'. This base ring 48' is provided with recess slots 49 into which tabs 51 of the central support structure 16 may be received, e.g. bayonet connection. This can assist with alignment of the components with respect to one another. The base ring 48 may also cooperate with the upper portion of the central support structure 16 to securely connect or stack multiple units while retaining the storage feature in connected units. For example, in stacking use, the base ring 48 may help secure and otherwise cooperate with an upper ring 50 of a second device 10. One example of stacked units is illustrated by FIG. 10 and is further discussed below.

Figure 7:
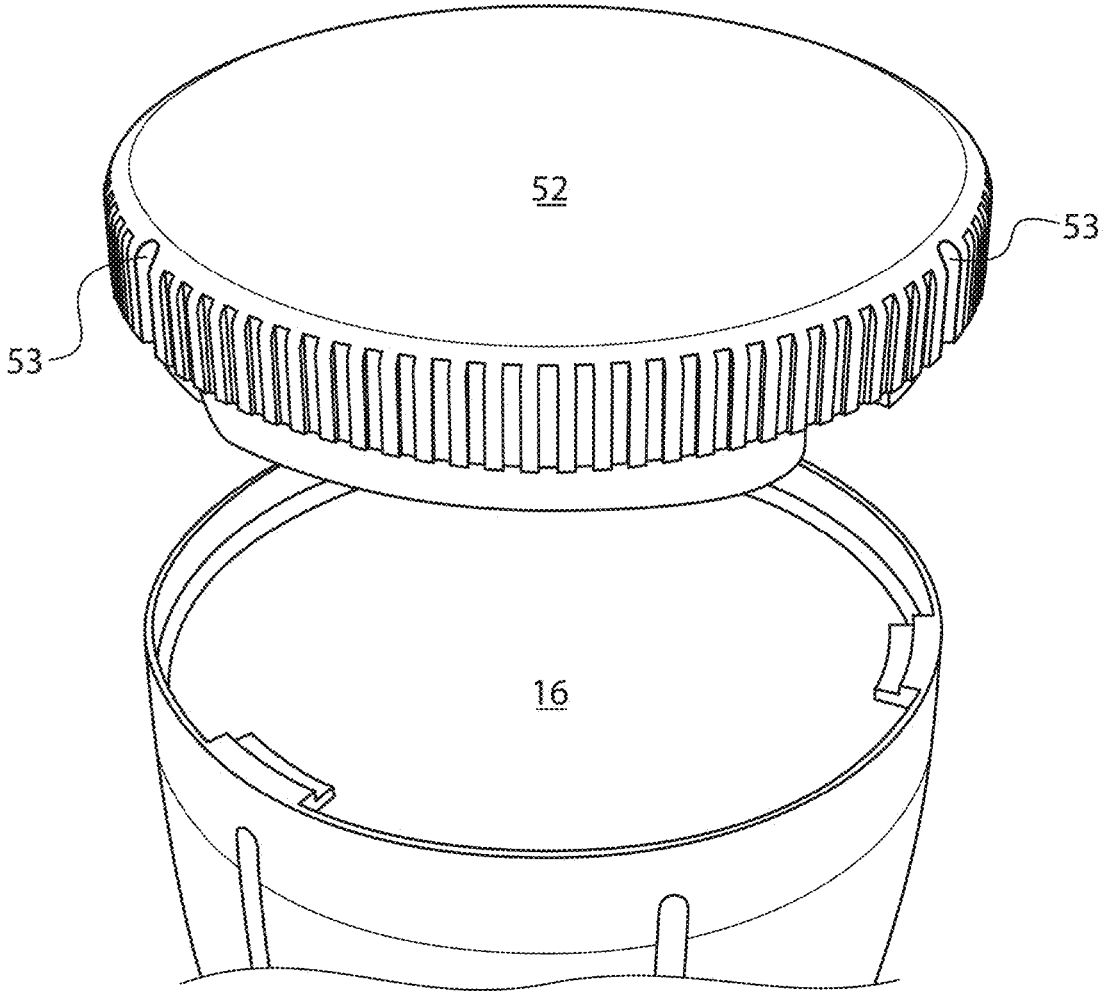
FIG. 7 illustrates an exploded view of a lid.
Figure 11:
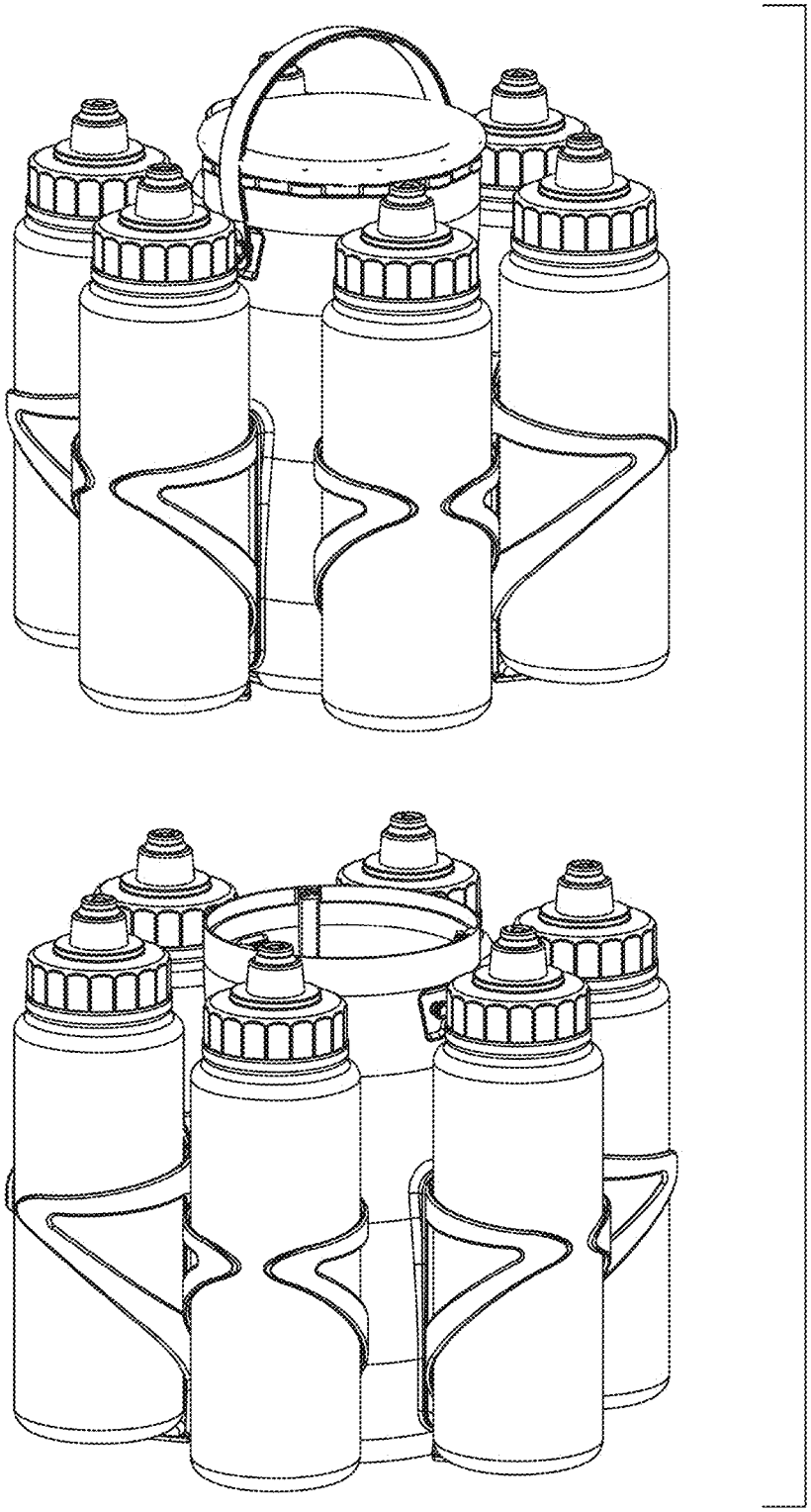
FIG. 11 illustrates an exploded view of FIG. 10.

Referring back to FIG. 4, the upper ring 50 may cooperate with an upper portion of the central support structure 16. The upper ring 50 may have features configured to threateningly cooperate with an upper portion of the central support structure 16. In an alternate embodiment, the upper ring 50 may snap fit onto the central support structure 16. Any other securement feature is possible and considered within the scope of this disclosure. Instead of or in addition to upper ring 50, a cap 52 may be provided which can enclose the interior storage space 42. FIG. 7 illustrates one embodiment of a cap 52. In this example, cap 52 is provided with one or more slots 53 that can assist with positioning the cap onto the structure 16. The slots 53 can align with tabs for proper positioning. The cap 52 may also be provided with knurled edges for easier gripping. FIG. 7 also illustrates slots that may be provided along the central support 16. These slots can provide visual alignment for the cap. They also may be used to help provide visual alignment if more than one unit is provided in a stacked configuration, as illustrated by FIGS. 10 and 11.

FIGS. 1-3 and 5 illustrate a carrying handle 60 option. Although a handle 60 is shown, it should be understood that other carrying features are possible and considered within the scope of this disclosure, such as a rope, a hanger, or any other support feature.

Figure 8A:
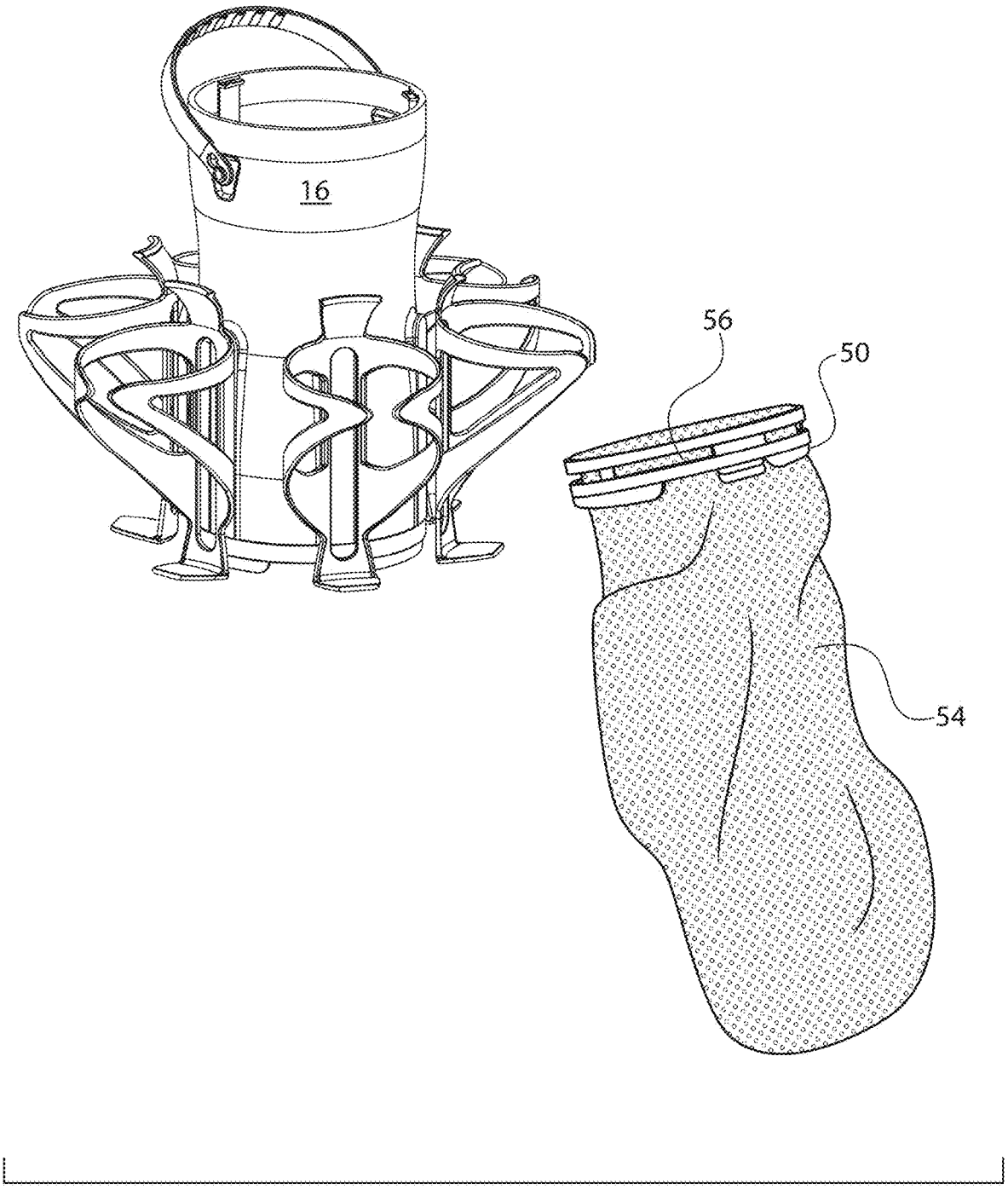
FIG. 8A illustrates a mesh bag that may be positioned within the central support structure.
Figure 8B:
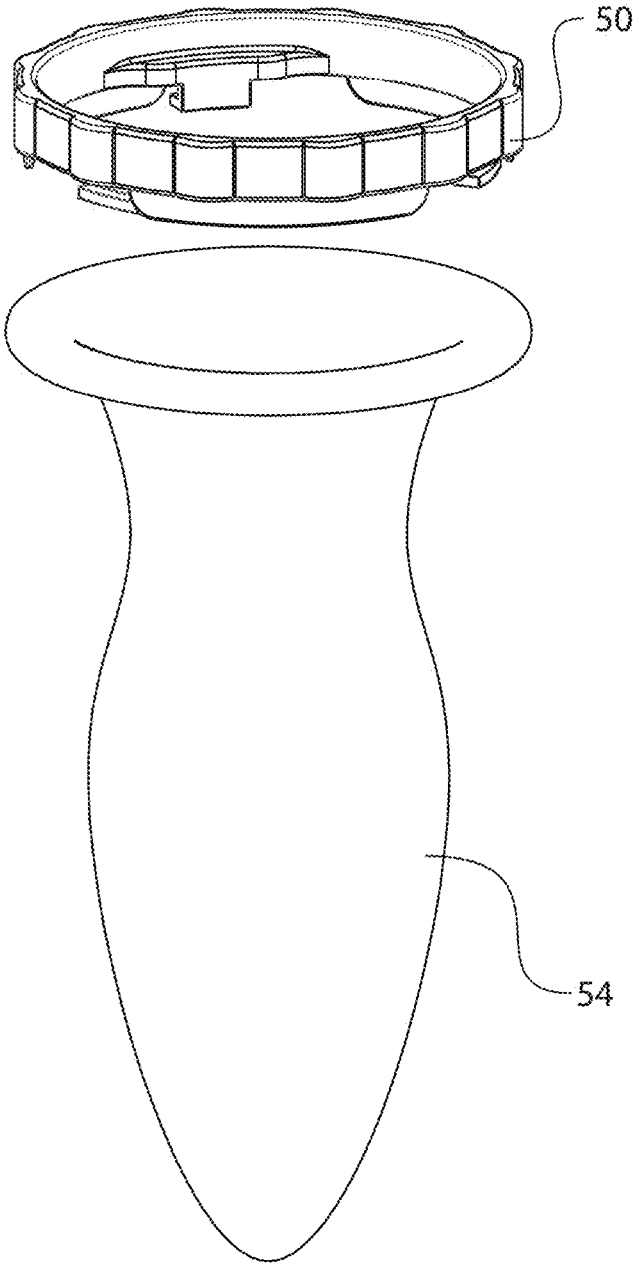
FIG. 8B illustrates a side exploded view of a mesh bag with an accompanying ring.
Figure 9:
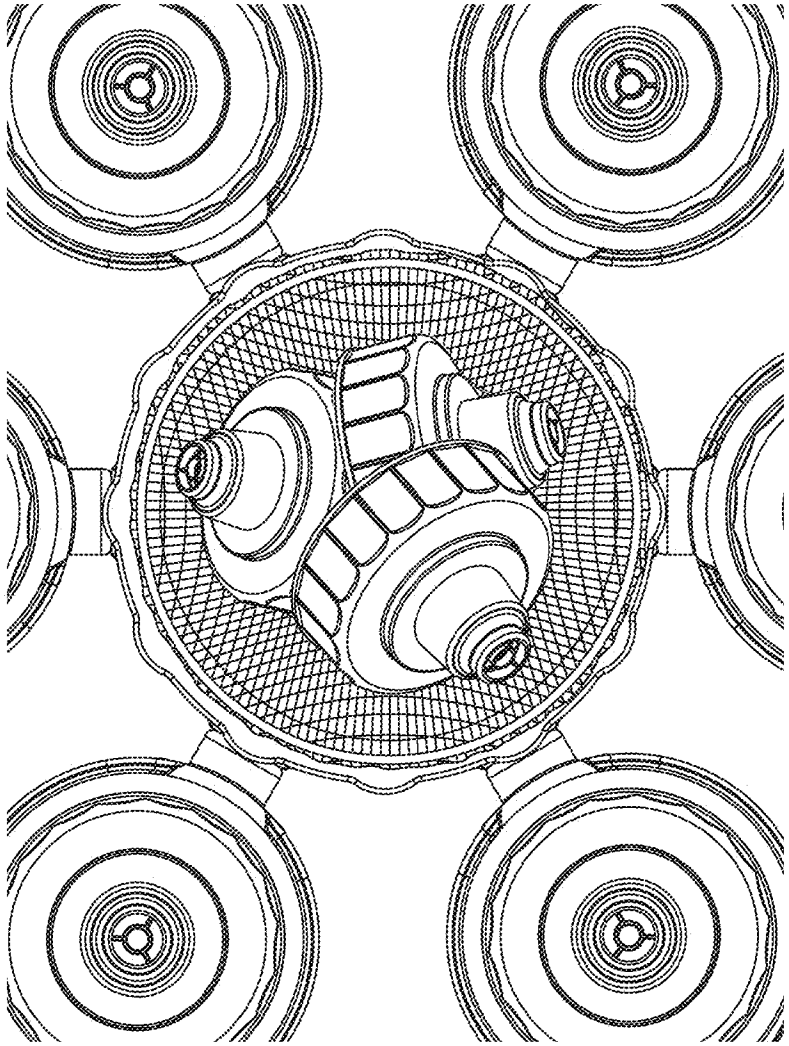
FIG. 9 illustrates a top perspective view of a mesh bag positioned within a central support structure.

As illustrated by FIGS. 8A and 8B, the upper ring 50 and/or cap 52 may be associated with a storage bag 54. As illustrated, the storage bag may be a fabric mesh material that allows air circulation in and around the items contained within the bag 54. In a specific example, the storage bag 54 may be overmolded or glued to the inside of upper ring 50 to securely attach the storage bag. In another example, the bag 54 may be stitched to or around the upper ring 50. In a specific example, the upper ring may have optional side slits 56 that allow attachment of the storage bag 54. The upper ring 50 may then be secured to the central support structure 16 as illustrated by FIG. 9. The bag 54 is contained within the interior storage space 42. In use, the bag 54 is inserted into the interior storage space 42 of the central support structure 16. A user may position one or more lids, keys, electronic devices, headphones, snacks, energy gels or tablets, or any other item within the storage bag 54. When the upper ring/cap/storage bag is positioned with respect to the central support structure 16, the user may carry bottles, lids, as well as any other smaller items within the storage bag 54. The bag may have a stitched base or may have a cinch cord to close its base.

The carrier and storage device of the present invention may be formed as a modular unit that can be stacked with one or more other carrier and storage devices depending on user requirements. The modularity of the carrier and storage devices of the present invention whereby each of the bottle carrier and storage devices 10 form a module unit and as illustrated by FIGS. 10 and 11, allows more than one bottle carrier and storage device 10 to be stacked on top of each other. For example, multiple sets of single units or devices can be connected to hold 12, 18, 24 or even more water bottles. In use, one or both of the upper ring 50 or cap 52 may be removed and a second device 10' may have its central support structure 16' aligned with the lower device's central support structure 16. For example, in use, the upper ring 50 or cap 52 may be removed and a second device 10' may have its central support structure 16' and base ring 48' connected to another device upper portion 16 in the same fashion as the upper ring 50 or cap 52. Alternatively, the upper ring 50 and/or cap 52 can be shaped to cooperate with the base ring 48 attached to the base of the central support structure 16 and thereby, allowing the central support structure 16 and the base ring 48 of one device to connect to another device via the cooperation of the upper ring 50 and/or cap 52. In both cases, the central support structure of multiple devices can cooperate with one another by any means known in the art. For example, cooperation means can be through a snap fit connection, threaded connection or a bayonet type connection, or any other appropriate connection. This process allows two, three, or more devices 10 to be securely connected or stacked.

The embodiments described herein may be used as retail display for bottles. In other examples, the embodiments described herein may be used for branding. For example, a particular bike shop or bike team may choose to have their logo applied to one or more portions of the device.

Figure 13:
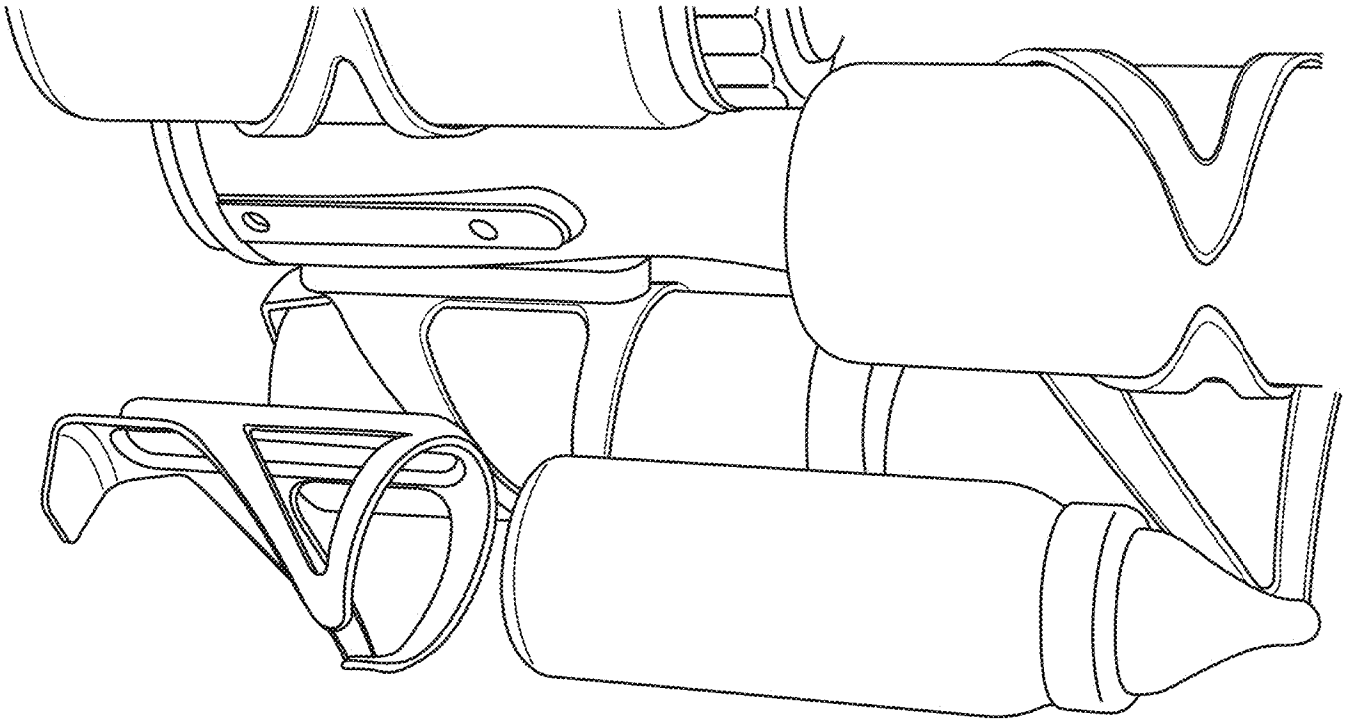
FIG. 13 illustrates a bottle carrier and storage device having a smaller bracket configured for holding, storing and/or carrying a baby bottle.

FIG. 13 illustrates an embodiment that has a bracket that is smaller than the others illustrated, which can be used to hold, store or carry a baby bottle. Although a single smaller bracket is illustrated, it should be understood that an entire carrying device may be fitted with smaller brackets for use in carrying a plurality of baby bottles or other type of smaller sized bottle. For example, the device of the present invention can have a modular construction allowing different components of the device, e.g. the bracket, to be interchangeable with other components such as different types of brackets or even a lid support 36.

It should be understood that various different features described herein may be used interchangeably with various embodiments. For example, if one feature is described with respect to particular example, it is understood that that same feature may be used with other examples as well.

The material of the device may be injection molded plastic. This may help ease design. It is also possible for the device to be manufactured of metal. In one example, the device may be a metal canister that can be vacuum sealed or insulated with an inner and outer liner and provided as watertight vessel for holding hot or cold liquids. The outer surface may then be used for receiving brackets for bottle securement. Various sizes may be manufactured. In one example, the canister or central portion size is about four inches in diameter. However, it should be understood that other sizes are possible and considered within the scope of this disclosure. It is possible for the canister or central portion to be about 2-3 inches in diameter or up to about 5-6 inches in diameter. Various methods may be used to attach the cap to the canister or central portion. Non-limiting examples include screw threads, snap on, tongue and groove, fliptop, or any other appropriate securement method.

Changes and modifications, additions and deletions may be made to the structures and methods recited above and shown in the drawings without departing from the scope or spirit of the disclosure or the following claims.

What is claimed is:

1. A bottle carrier and storage device, comprising:

a central support structure that is hollow and defines an interior storage space; one or more brackets extending from the central support structure, each of the one or more brackets comprising a bottle cage with an elongated, hollow bottle-receiving opening defined by at least one curved arm shaped configured to receive and secure a bottle, wherein the central support structure comprises a base, wherein each of the one or more brackets comprise a bottom, and wherein the base of central support structure and the bottom of the one or more brackets are on the same plane, and a removable lower platform.

2. A bottle carrier and storage device, comprising:

a central support structure that is hollow and defines an interior storage space;

one or more brackets extending from the central support structure, each of the one or more brackets comprising a bottle cage with an elongated, hollow bottle-receiving opening defined by at least one curved arm shaped configured to receive and secure a bottle, wherein the central support structure comprises a base, wherein each of the one or more brackets comprise a bottom, and wherein the base of central support structure and the bottom of the one or more brackets are on the same plane, and a lid support comprising at least one channel to receive a drinking feature of a bottle lid in a vertical orientation.

3. A bottle carrier and storage device, comprising:

a central support structure that is hollow and defines an interior storage space; one or more brackets extending from the central support structure, each of the one or more brackets comprising a bottle cage with an elongated, hollow bottle-receiving opening defined by at least one curved arm shaped configured to receive and secure a bottle, wherein the central support structure comprises a base, wherein each of the one or more brackets comprise a bottom, and wherein the base of central support structure and the bottom of the one or more brackets are on the same plane, wherein the bottle carrier and storage device comprises a first unit and further comprising a second bottle carrier and storage device comprising a second unit, the second unit configured to be mounted with respect to the first unit via an lowermost portion of the first unit cooperating with an uppermost portion of the second unit, such that the first and second units are securely attached top to bottom and create a multi-story unit.

4. A bottle carrier and storage device, comprising:

a central support structure that is hollow and defines an interior storage space;

one or more brackets extending from the central support structure, each of the one or more brackets comprising a bottle cage with an elongated, hollow bottle-receiving opening defined by at least one curved arm shaped configured to receive and secure a bottle, wherein the central support structure comprises a base, wherein each of the one or more brackets comprise a bottom, and wherein the base of central support structure and the bottom of the one or more brackets are on the same plane, wherein the one or more brackets are interchangeable with one or more bottle lid supports.

5. The device of claim 4, wherein the one or more brackets are configured to be removably secured to the central support structure.

6. The device of claim 4, further comprising a storage bag configured to be secured with respect to the central support structure.

7. The device of claim 6, wherein the storage bag is secured to an upper ring or cap that cooperates with an upper portion of the central support structure and covers and secures an upper portion of the storage bag.

8. The device of claim 6, wherein the storage bag comprises a fabric mesh bag.

9. The device of claim 6, wherein the central support structure comprises a cap or an upper ring for cooperating with an upper portion of the central support structure, and wherein an upper portion of the storage bag is secured to the upper ring or the cap, and wherein the cap or upper ring covers and secures an upper portion of the storage bag.

10. The device of claim 4, wherein the central support structure is cylindrical.

11. The device of claim 4, wherein the at least one curved arm of the at least one bracket comprises two curved arms defining the hollow bottle-receiving opening, wherein the bottle-receiving opening can hold both tapered or non-tapered bottles such that bottles remain secured when the unit is being carried or placed on a flat surface.

12. The device of claim 4, further comprising a carrying feature secured to the central support structure.

13. A stack of modular units, wherein each of the modular units comprises a bottle carrier and storage device comprising:

a central support structure that is hollow and defines an interior storage space; one or more brackets extending from the central support structure, each of the one or more brackets comprising a bottle cage with an elongated, hollow bottle-receiving opening defined by at least one curved arm shaped configured to receive and secure a bottle, wherein the central support structure comprises a base, wherein each of the one or more brackets comprise a bottom, and wherein the base of central support structure and the bottom of the one or more brackets are on the same plane, wherein the devices are threadingly attachable to one another, and wherein each of the devices maintains its ability to carry bottles even when attached to another device in a multi-story unit.

14. The stack of claim 13, wherein the central support structure of the second unit comprises an upper ring that is removable to allow a threaded uppermost portion of the second unit to receive a threaded lowermost portion of the first.

15. The stack of claim 13, wherein the lowermost portion of the first unit comprises a removable base ring arranged to cooperate with the uppermost portion of the second unit.

* * * * *